US006095574A

United States Patent [19]

Dean

[11] Patent Number: 6,095,574

[45] Date of Patent: Aug. 1, 2000

[54] COMPUTER ENCLOSURE LOCKING MECHANISM

[75] Inventor: Ronald P Dean, Fort Collins, Colo.

[73] Assignee: Hewlett-Packard Company, Palo Alto, Calif.

[21] Appl. No.: 09/323,755

[22] Filed: Jun. 1, 1999

[51] Int. Cl.[7] ..... E05C 1/12

[52] U.S. Cl. ..... 292/164; 292/177; 292/284; 70/2; 70/58; 70/81; 70/162; 70/164

[58] Field of Search ..... 292/175, 145, 292/164, 138, 169, 140, 177, 179, 281, 283, 284, 282, DIG. 11, 148; 70/158, 160, 162, 164, 167, 169, 2, 81, 58; 312/223.2, 223.1; 361/726

[56] References Cited

U.S. PATENT DOCUMENTS

| | | | |
|---|---|---|---|
| 1,561,018 | 11/1925 | Peelle | 292/111 |
| 2,183,291 | 12/1939 | Haught | 70/141 |
| 3,233,932 | 2/1966 | Utterback | 292/175 |
| 3,626,507 | 12/1971 | Hawkins | 292/175 |
| 4,045,982 | 9/1977 | Gorton et al. | 70/90 |
| 4,777,812 | 10/1988 | Haugen | 70/232 |
| 5,024,146 | 6/1991 | Dull | 99/458 |
| 5,104,163 | 4/1992 | Palmer, Jr. et al. | 292/335 |
| 5,228,319 | 7/1993 | Holley et al. | 70/58 |
| 5,526,226 | 6/1996 | Katoh et al. | 361/680 |
| 5,681,067 | 10/1997 | MacIntyre | 292/163 |
| 5,787,737 | 8/1998 | Cho | 70/58 |
| 5,857,364 | 1/1999 | Hsu et al. | 70/120 |

*Primary Examiner*—B. Dayoan
*Assistant Examiner*—John B. Walsh
*Attorney, Agent, or Firm*—Kevin M. Hart

[57] ABSTRACT

A computer enclosure locking mechanism. A bracket is disposed near the edge of a first enclosure panel. The bracket includes a latchpin retaining surface and a standoff member. The first panel includes a first latchpin clearance hole. The standoff member includes a lock bar clearance hole for receiving the lockbar of a padlock or other locking device. A retractable latchpin having a longitudinal member and a head is provided. A spring is disposed coaxially around the longitudinal member. A second enclosure panel includes a second latchpin clearance hole that aligns with the first latchpin clearance hole when the first and second panels are brought together at a seam. When the latchpin is retracted, the head rests against the latchpin retaining surface and the longitudinal member extends through the first clearance hole but not through the second clearance hole, thereby enabling the first and second panels to be separated or brought together. When the spring is depressed so that the head of the latchpin lies between the first panel and the lock bar clearance hole, the longitudinal member of the latchpin extends through both of the first and the second clearance holes, thereby preventing the first and second panels from being separated.

12 Claims, 5 Drawing Sheets

FIG. 3
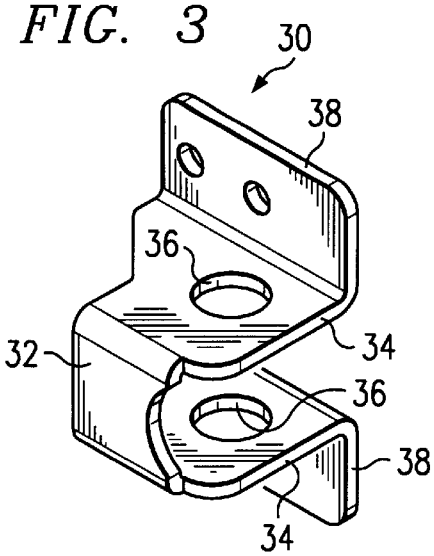
FIG. 6
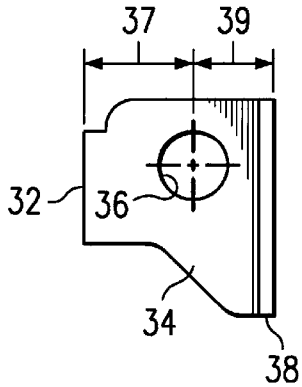
FIG. 4
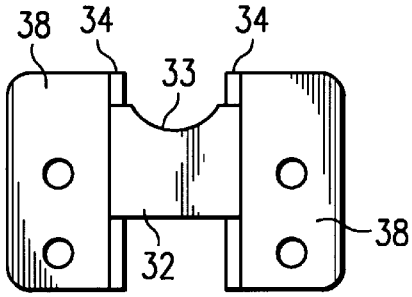
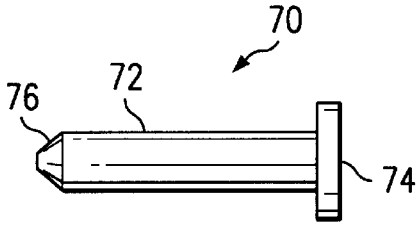
FIG. 7
FIG. 5
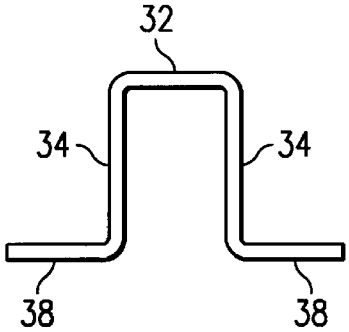
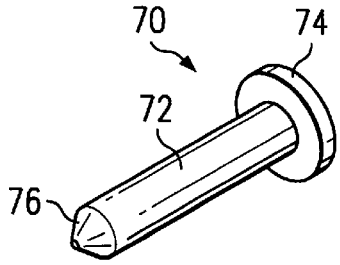
FIG. 8

COMPUTER ENCLOSURE LOCKING MECHANISM

FIELD OF THE INVENTION

This invention relates to methods and apparatus for locking computer enclosures in order to prevent access to internal components.

BACKGROUND

Depending on the environment in which a computer will be used, it is sometimes necessary or desirable to ensure that unauthorized persons are not able to access components that are contained within the enclosure of the computer. For example, opportunities for theft, accidental user injury and unauthorized reconfiguration may be reduced significantly by locking a computer enclosure shut.

It is therefore an object of the present invention to provide a mechanism for locking a computer enclosure shut in order to prevent unauthorized access to components that are contained within the computer enclosure.

It is a further object to provide a computer enclosure locking mechanism that remains attached to the computer enclosure when the mechanism is unlocked, thereby preventing loss of the mechanism when it is not in use.

It is a further object to provide a computer enclosure locking mechanism that may be used equally well with a variety of differently-sized padlocks, locking cables or other locking devices.

SUMMARY OF THE INVENTION

In one embodiment, a bracket is disposed on the outer side of a first computer enclosure panel proximate to a seam at which the first panel may be brought together with a second panel. The bracket includes a latchpin retaining surface and a standoff member for displacing the latchpin retaining surface away from the first panel over a first latchpin clearance hole formed in the first panel. The standoff member includes a lock bar clearance hole for receiving the lockbar of a padlock or other locking device. A latchpin having a longitudinal member and a head is provided, and a spring is disposed coaxially around the longitudinal member of the latchpin. The latchpin and spring are assembled into the bracket such that the head of the latchpin is on the outer side of the first panel, the end of the latchpin opposite the head extends at least partially through the first latchpin clearance hole, one end of the spring engages the under side of the latchpin head, and the other end of the spring engages a spring retaining surface that is fixed relative to the latchpin. The second panel includes a second latchpin clearance hole at a location such that, after the first and second panels have been brought together at the seam, the first and second latchpin clearance holes are aligned with one another and the second latchpin clearance hole is disposed on the inner side of the first panel. When the spring is extended and the head of the latchpin rests against the latchpin retaining surface of the bracket, the longitudinal member of the latch pin extends through the first clearance hole but not through the second clearance hole, thereby enabling the first and second panels to be brought together at the seam and the first and second clearance holes to be aligned. But when the spring is depressed so that the head of the latchpin lies between the first panel and the lock bar clearance hole, the longitudinal member of the latchpin extends through both of the first and the second clearance holes, thereby preventing the first and second panels from being displaced from one another at the seam.

BRIEF DESCRIPTION OF THE DRAWINGS

FIG. 3 is an oblique view of a bracket of the locking mechanism of FIG. 1.

FIGS. 4, 5 and 6 are orthographic projections of the bracket of FIG. 3.

FIGS. 7 and 8 are orthographic and oblique views, respectively, of a latchpin of the locking mechanism of FIG. 1.

DETAILED DESCRIPTION OF THE PREFERRED EMBODIMENTS

Figure 1:
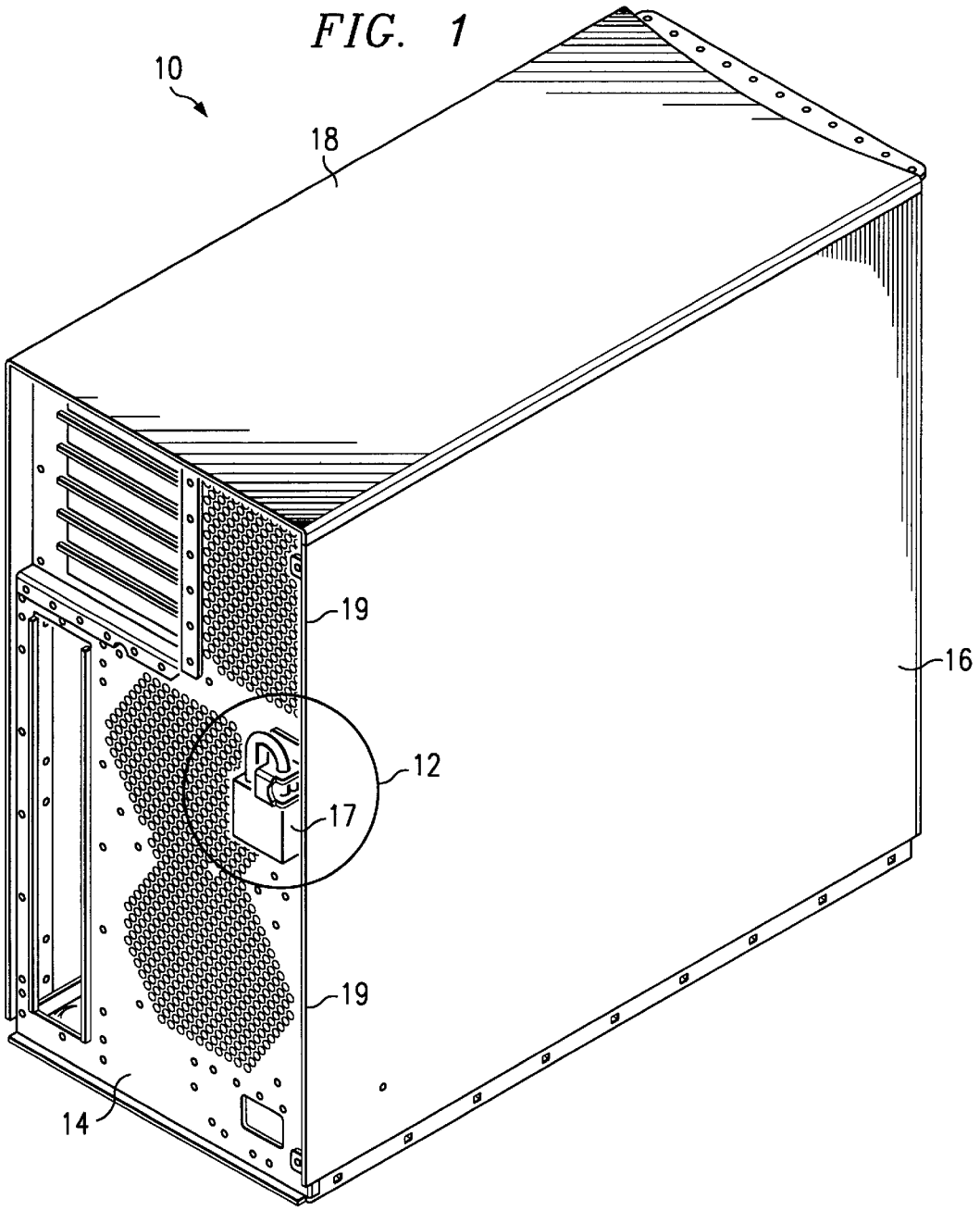
FIG. 1 is an oblique view of a computer enclosure incorporating a locking mechanism according to a preferred embodiment of the invention.

FIG. 1 illustrates a computer enclosure 10 incorporating a locking mechanism 12 according to a preferred embodiment of the invention. Although locking mechanism 12 may be used with a variety of different styles of computer enclosures, computer enclosure 10 will be used herein to describe the preferred construction and functionality of locking mechanism 12. Computer enclosure 10 is a volume enclosed by six sides formed with sheet metal panels. Main panel 18 forms the top, bottom and one side of enclosure 10. End panels such as end panel 14 are attached to main panel 18 at the front and rear of enclosure 10. Side panel 16 is the only one of the six sides of enclosure 10 that may be opened or removed.

Figure 2:
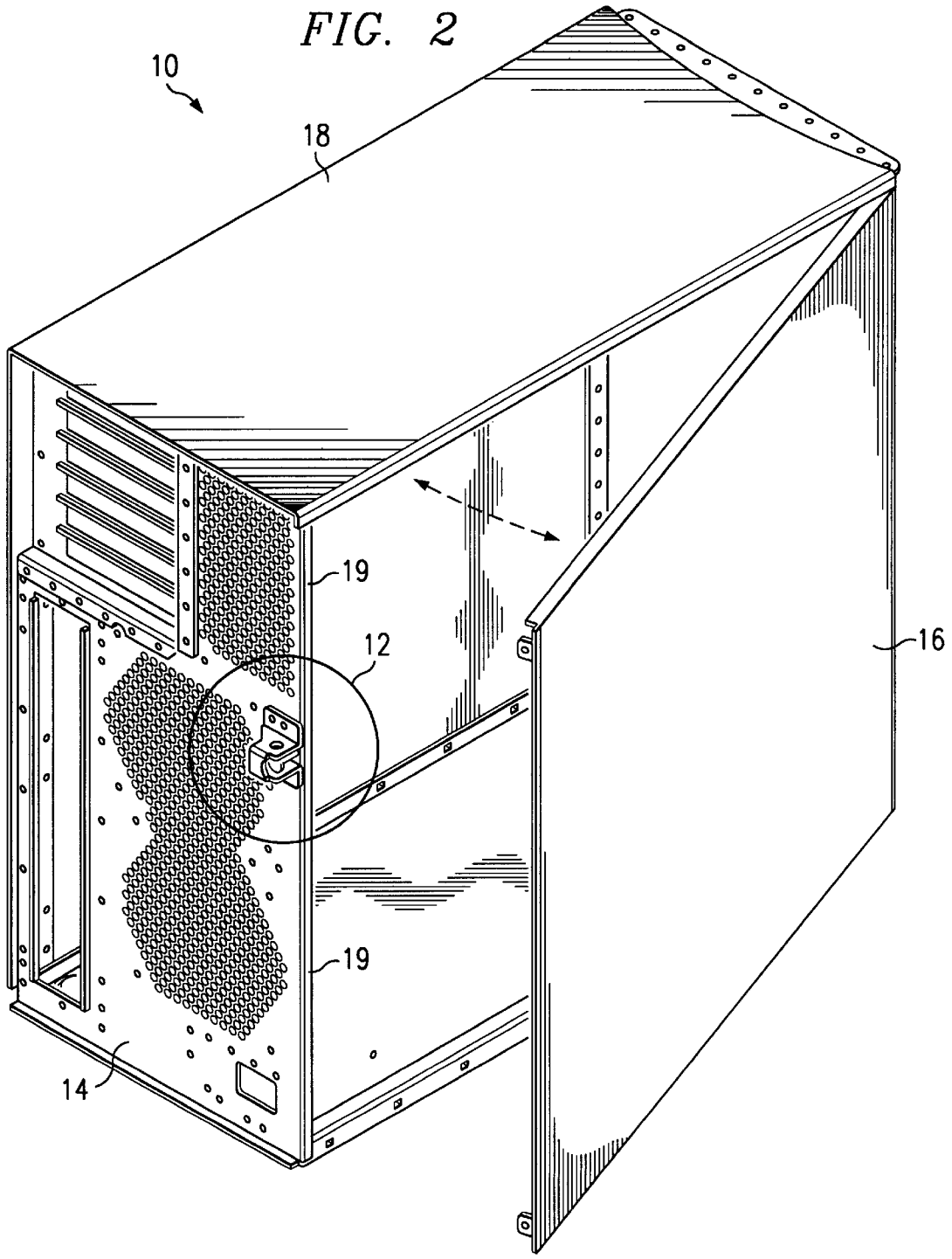
FIG. 2 is an oblique view of the computer enclosure of FIG. 1 having been opened.

In the embodiment shown, locking mechanism 12 is disposed on the outside of end panel 14 and is used to prevent side panel 16 from being displaced from end panel 14 at seam 19. Locking mechanism 12 may be attached to end panel 14 by riveting or other conventional fastening means. In other embodiments, locking mechanism 12 may be attached to other panels of the enclosure. A padlock 17 or other locking device may be inserted into locking mechanism 12, as shown, to further secure enclosure 10 from unauthorized access. FIG. 2 illustrates enclosure 10 after padlock 17 has been removed from locking mechanism 12 and after side panel 16 has been hinged away from end panel 14.

Locking mechanism 12 includes a bracket 30 as shown in FIGS. 3–5. In an embodiment, bracket 30 was made of metal, although other substantially rigid materials may be used. Bracket 30 includes a latchpin retaining surface 32, standoff members 34 and mounting surfaces 38. The purpose of standoff members 34 is to displace latchpin retaining surface 32 away from end panel 14 over a latchpin clearance hole formed in end panel 14 (to be further described below). Standoff members 34 include lockbar clearance holes 36 located a distance 37 away from latchpin retaining surface 32 and a distance 39 away from mounting surfaces 38. The purpose of lockbar clearance holes 36 is to receive the lockbar of a padlock or other locking device. Preferably, the diameter of lockbar clearance holes 36 should be large enough to enable a variety of padlocks or other locking devices to be used with locking mechanism 12. The purpose of latchpin retaining surface 32 is to retain latchpin 70 (described below) within locking mechanism 12 when latchpin 70 is in its retracted position. The purpose of mounting surfaces 38 is to fixedly attach bracket 30 to end panel 14, for example by riveting.

Locking mechanism 12 also includes a latchpin 70 as shown in FIGS. 7 and 8. Latchpin 70 includes a longitudinal member 72 and a head 74. Preferably, longitudinal member 72 is pointed to facilitate alignment of latchpin 70 with clearance holes in end panel 14 and side panel 16.

Figure 9:
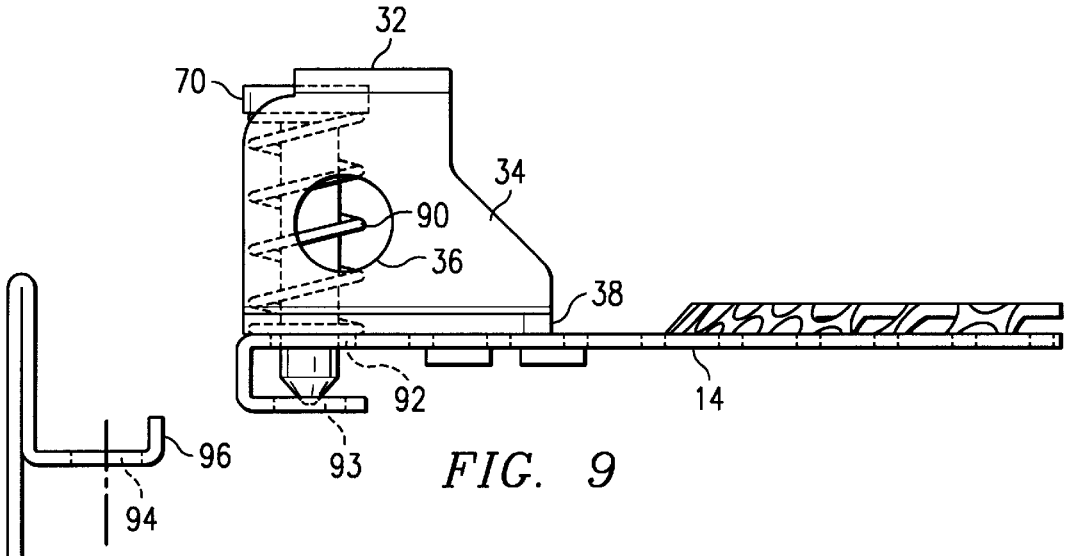
FIG. 9 is a sectional view of the locking mechanism of FIG. 1 showing the latchpin retracted and a side panel of the computer enclosure ajar.
Figure 10:
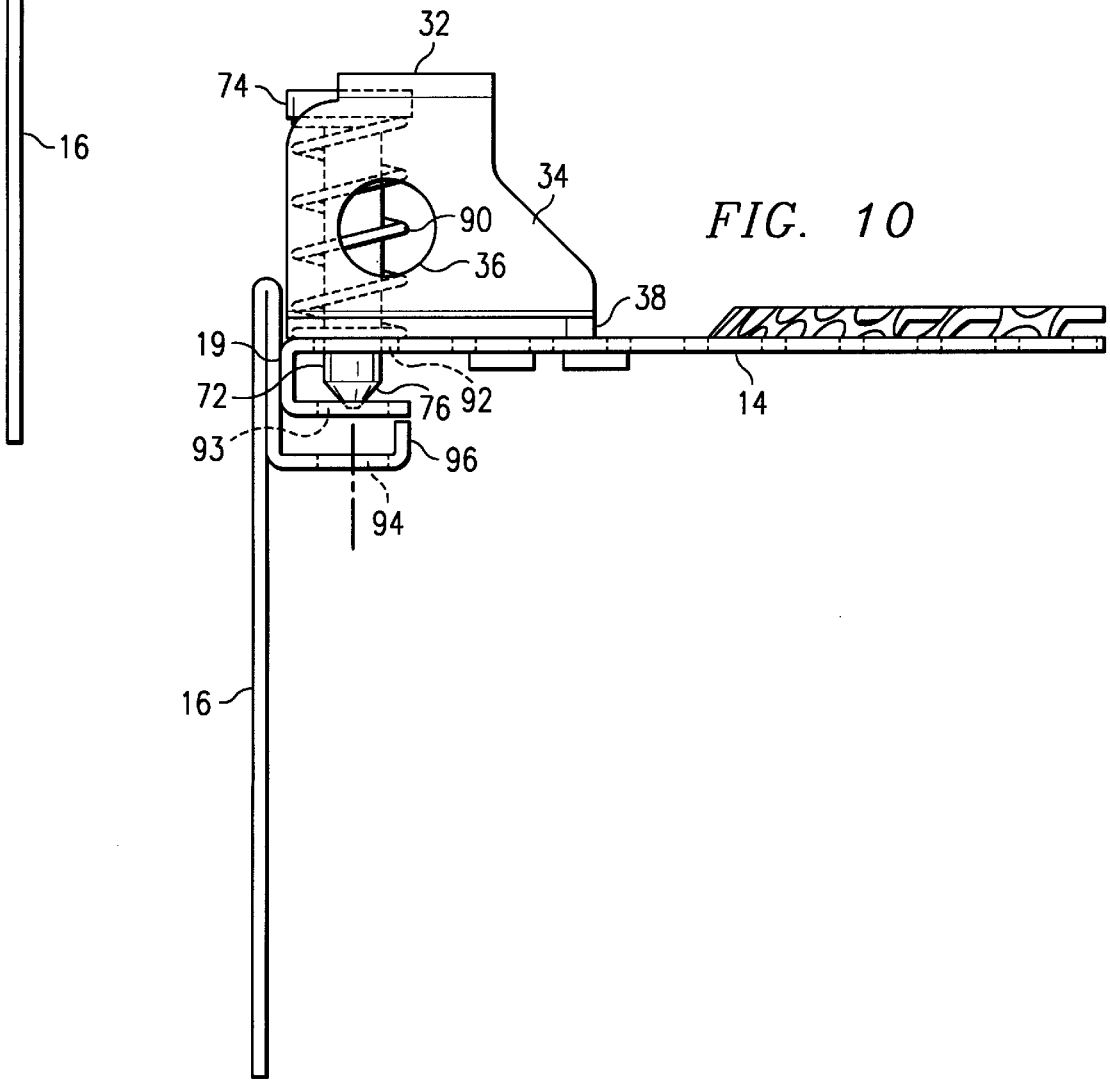
FIG. 10 is a sectional view of the locking mechanism of FIG. 1 showing the latchpin retracted and the side panel brought together with a rear panel forming a seam.
Figure 11:
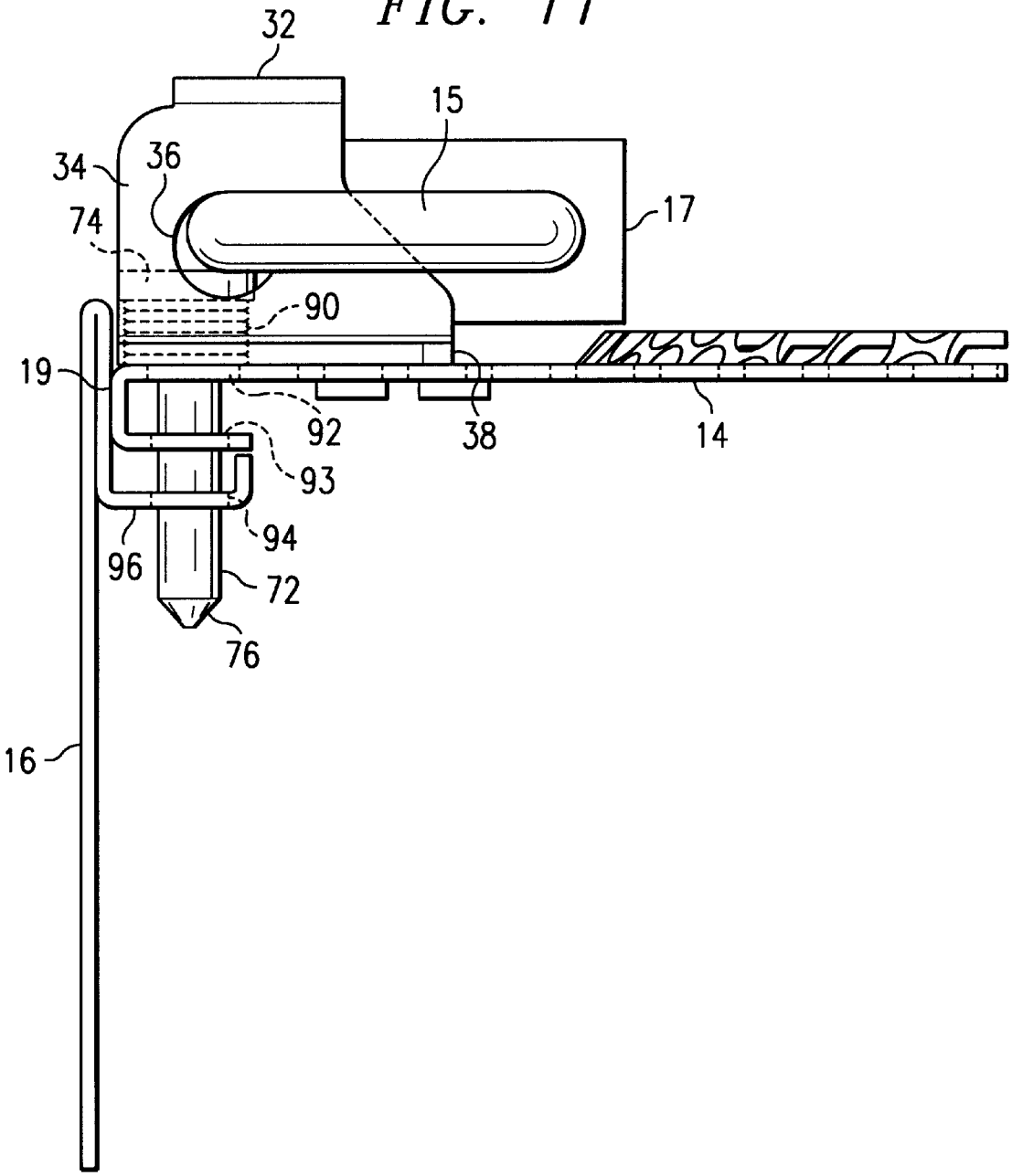
FIG. 11 is a sectional view of the locking mechanism of FIG. 1 showing the latchpin depressed and a padlock inserted into a lockbar clearance hole of the bracket.

As can be seen in FIGS. 9–11, a spring 90 is disposed coaxially around longitudinal member 72 of latchpin 70. When locking mechanism 12 is assembled, one end of spring 90 engages the under side of head 74 of latchpin 70. The other end of spring 90 engages either the outside of end panel 14 or some other suitable spring retaining surface that is fixed relative to latchpin 70. The result of this arrangement is that spring 90 urges latchpin 70 away from end panel 14; but latchpin 70 is retained within locking mechanism 12 by virtue of head 74 engaging latchpin retaining surface 32 on bracket 30, as shown in FIGS. 9 and 10. Latchpin 70 is further retained while in its retracted position by virtue of the fact that longitudinal member 72 extends through clearance hole 92 in end panel 14 even when latchpin 70 is retracted.

Side panel 16 has a lip 96 formed thereon that extends orthogonally away from the inside surface of side panel 16. Lip 96 has a latchpin clearance hole 94 formed therein. When latchpin 70 is retracted, side panel 16 may be brought together with end panel 14 at seam 19 and clearance hole 94 aligned with clearance holes 92 and 93, as shown in FIG. 10. Thereafter, spring 90 may be depressed by pushing head 74 down toward end panel 14. As this is done, longitudinal member 72 passes through clearance holes 93 and 94. Finally, lockbar 15 of padlock 17 or another suitable locking device may be inserted through lockbar clearance holes 36. Lockbar 15 engages head 74 and prevents latchpin 70 from retracting.

Latchpin 70 and distances 37 and 39 may be any suitable size, so long as latchpin 70 clears clearance hole 94 when retracted and passes through clearance hole 94 when latchpin 70 is depressed until head 74 passes lockbar clearance hole 36. In an embodiment, all of the components of locking mechanism 12 were made of metal, although other suitable materials may be used. In a preferred embodiment, bracket 30 was formed with an indentation 33 in latchpin retaining surface 32. Indentation 33 allows a portion of head 74 of latchpin 70 to be exposed when latchpin 70 is retraced. This facilitates depressing latchpin 70 with a finger.

While the invention has been described in detail in relation to a preferred embodiment thereof, the described embodiment has been presented by way of example and not by way of limitation. It will be understood by those skilled in the art that various changes may be made in the form and details of the described embodiment, resulting in equivalent embodiments that will remain within the scope of the appended claims.

What is claimed is:

1. A computer enclosure locking mechanism, comprising:

first and second panels capable of preventing access to the computer enclosure when brought together at a seam and providing access to the computer enclosure when displaced from one another at the seam;

a bracket disposed on the outside of the first panel proximate to the seam, the bracket having a latchpin retaining surface and a standoff member for displacing the latchpin retaining surface away from the first panel and over a first latchpin clearance hole formed in the first panel, the standoff member including a lock bar clearance hole disposed a first distance away from the latchpin retaining surface and a second distance away from the outside of the first panel;

a latchpin having a longitudinal member and a head at one end; and a spring disposed coaxially around the longitudinal member of the latchpin;

the latchpin and spring disposed such that the head of the latchpin is on the outside of the first panel, the end of the latchpin opposite the head extends at least partially through the first latchpin clearance hole, one end of the spring engages a spring retaining surface that is fixed relative to the latchpin, and the other end of the spring engages the head of the latchpin;

the second panel having a second latchpin clearance hole formed therein at a location such that, after the first and second panels have been brought together at the seam, the first and second latchpin clearance holes are aligned with one another and the second latchpin clearance hole is disposed on the inside of the first panel; and the lengths of the latchpin and the first and second distances being sized so that: when the spring is extended and the head of the latchpin rests against the latchpin retaining surface of the bracket, the longitudinal member of the latch pin extends through the first clearance hole but not through the second clearance hole, thereby enabling the first and second panels to be brought together at the seam and the first and second clearance holes to be aligned;

but when the spring is depressed so that the head of the latchpin lies between the lock bar clearance hole and the outside of the first panel, the longitudinal member of the latchpin is capable of extending through both of the first and the second clearance holes, thereby preventing the first and second panels from being displaced from one another at the seam.

2. The computer enclosure locking mechanism of claim 1:

wherein the latchpin retaining surface of the bracket engages only a first portion of the head of the latchpin when the spring is extended, leaving a second portion of the head exposed, so as to facilitate depressing the latchpin and spring by pushing the head toward the first panel.

3. The computer enclosure locking mechanism of claim 1:

wherein the end of the latchpin opposite the head is pointed to facilitate alignment of the pin with the second clearance hole as the spring is depressed and the head moved toward the first panel.

4. The computer enclosure locking mechanism of claim 1:

wherein the first and second panels are substantially orthogonal to one another after they have been brought together at the seam; and wherein the second clearance hole is formed on a lip that extends orthogonally away from the inside surface of the second panel.

5. The computer enclosure locking mechanism of claim 4:

wherein the first panel comprises an end panel of a chassis of the computer enclosure and the second panel comprises a removable side panel of the computer enclosure.

6. The computer enclosure locking mechanism of claim 1:

wherein the standoff member of the bracket comprises first and second rigid walls disposed orthogonally with the latchpin retaining surface, the ends of the first and second rigid walls opposite the latchpin retaining surface having first and second mounting surfaces, respectively, that are fixedly engaged with the first panel.

7. The computer enclosure locking mechanism of claim 6:

wherein the latchpin retaining surface of the bracket engages only a first portion of the head of the latchpin when the spring is extended, leaving a second portion of the head exposed, so as to facilitate depressing the latchpin and spring by pushing the head toward the first panel.

8. The computer enclosure locking mechanism of claim 7:

wherein the first and second panels are substantially orthogonal to one another after they have been brought together at the seam; and wherein the second clearance hole is formed on a lip that extends orthogonally away from the inside surface of the second panel.

9. The computer enclosure locking mechanism of claim 8:

wherein the first panel comprises an end panel of a chassis of the computer enclosure and the second panel comprises a removable side panel of the computer enclosure.

10. The computer enclosure locking mechanism of claim 9:

wherein the end of the latchpin opposite the head is pointed to facilitate alignment of the pin with the second clearance hole as the spring is depressed and the head moved toward the first panel.

11. A computer enclosure locking mechanism, comprising:

a first panel defining a first latchpin clearance hole;

a bracket disposed on a side of the first panel proximate to a seam where the first panel mates with a second panel, the bracket suspending a latchpin retaining surface over the first latchpin clearance hole and including aligned lockbar retaining holes;

a latchpin having a longitudinal member and a head at one end; and a spring disposed coaxially around the longitudinal member;

wherein the latchpin is disposed so the head is on the bracket side of the first panel and the longitudinal member extends through the first latchpin clearance hole, the spring is extended between the first panel and the head of the latchpin, and the latchpin can be moved so the head passes from one side to the other side of the aligned lockbar retaining holes.

12. The computer enclosure locking mechanism of claim 11, wherein the second panel defines a second latchpin clearance hole that aligns with the first latchpin clearance hole when the first and second panels are mated at the seam; and wherein the longitudinal member passes through the second latchpin clearance hole when the latchpin is moved so the head is disposed between the first panel and the aligned lockbar clearance holes.

* * * * *